United States Patent [19]

Hung

[11] Patent Number: 4,765,009

[45] Date of Patent: Aug. 23, 1988

[54] MULTI-FUNCTIONAL BAR OF A MANUALLY OPERATED JACK

[76] Inventor: Michael Hung, 11th Fl., 624 Ming Chuan E. Rd., Taipei, Taiwan

[21] Appl. No.: 46,032

[22] Filed: May 4, 1987

[51] Int. Cl.[4] ..... B25F 1/00

[52] U.S. Cl. ..... 7/100; 7/138; 7/165; 81/124.7; 29/245

[58] Field of Search ..... 81/124.7, 177.1, 177.2, 81/125; 7/100, 138, 165; 29/245, 267

[56] References Cited

U.S. PATENT DOCUMENTS

| | | | |
|---|---|---|---|
| D. 49,037 | 5/1916 | Parsons | 7/100 |
| 3,318,176 | 5/1967 | Geier, Jr. | 81/177.1 |
| 4,295,395 | 10/1981 | Stifano | 81/124.7 |

FOREIGN PATENT DOCUMENTS

| | | | |
|---|---|---|---|
| 557220 | 12/1974 | Switzerland | 81/124.7 |

*Primary Examiner*—Roscoe V. Parker

*Attorney, Agent, or Firm*—Wenderoth, Lind & Ponack

[57] ABSTRACT

A multi-functional bar for a manual operated jack comprising a connecting section and a handle section; said connecting section made from a hard metallic pipe at one end formed in a shape adapted to fit in an operable portion of the jack and having another pipe end to connect to an end portion of said handle section; said handle section made from a solid metal having one end integrally formed with a screw-driver receivable in the pipe end of the connecting section and having another end integrally form with a socket mount; said socket mount having a center opening as that which can firmly receive a socket, said handle section received said socket as an independent socket wrench; said socket having a center recess of enclosure in a modified hexagonal configuration that the distance of one pair of opposite laterals of the enclosure is elongated, an insert in a direction along said distance variable in the enclosure so as to grip even a smallest regular hexagonal screw-nut or bolt-head firmly in the enclosure when turning of the wrench.

2 Claims, 2 Drawing Sheets

FIG.5
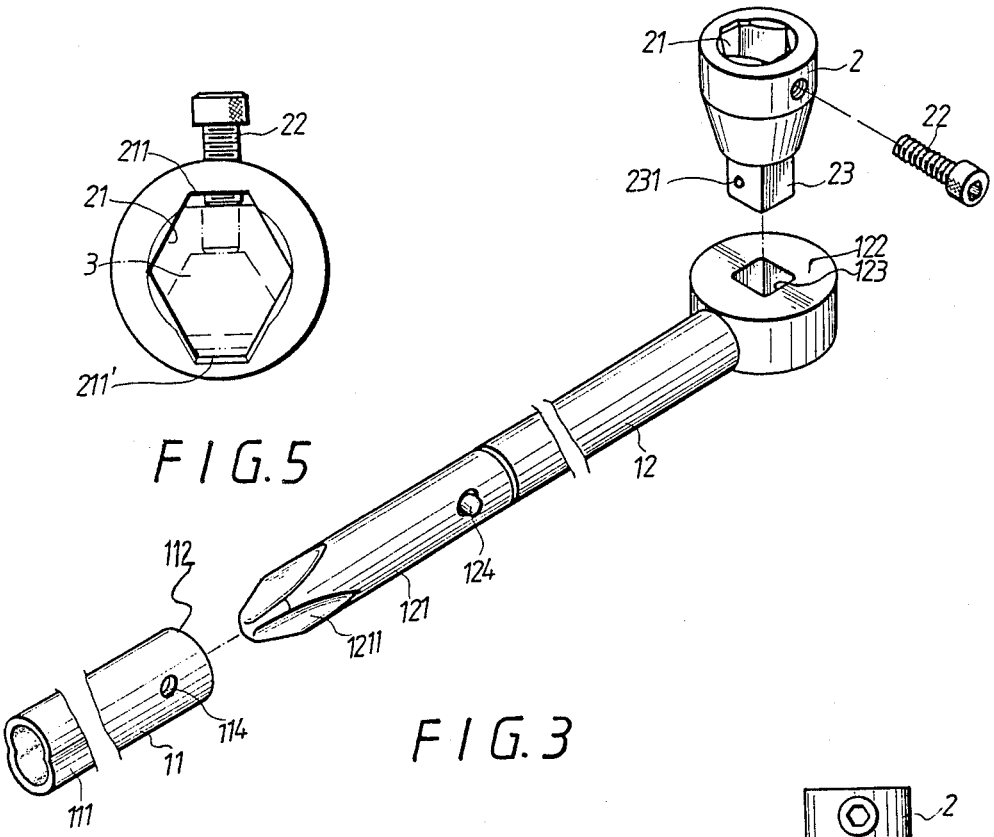
FIG.3
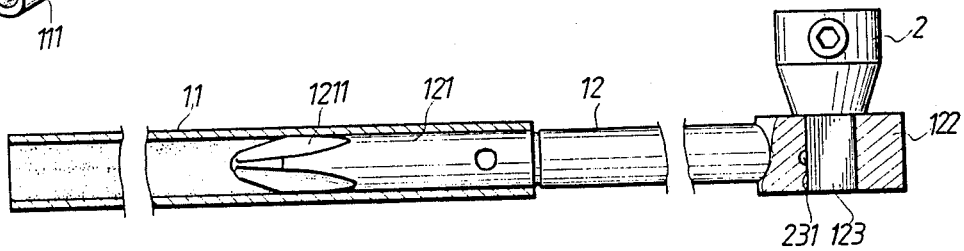
FIG.4
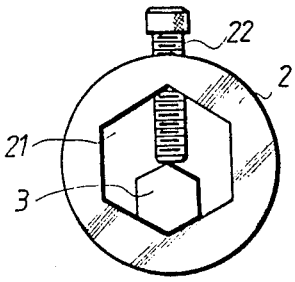
FIG.6A
PRIOR ART
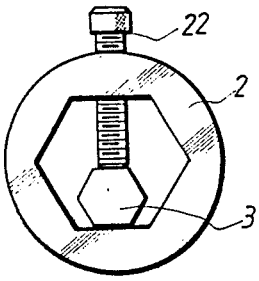
FIG.6B
PRIOR ART
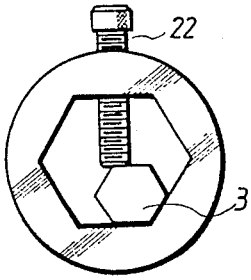
FIG.6C
PRIOR ART

MULTI-FUNCTIONAL BAR OF A MANUALLY OPERATED JACK

FIELD OF THE INVENTION

The present invention relates to a bar of a manual operated jack comprising a jack connecting section and a handle section, said handle section in one end provided with a screw-driver and another end with an adjustable wrench socket which therefore requires no additional screw-drivers and wrench sockets to be carried when use especially for a car.

BACKGROUND OF THE INVENTION

Currently, not some few people hesitate to carry lots of different tools like professional skilled workers but more or less they accidentially face some small troubles from their machines, especially their cars, and shall regulate or fix that. In those occassions, they found there might be some tools but lack of one important tool.

Among those occassions, most people faced troubles from their cars everywhere in high-ways, countries or deserts. For example, they may have spared wheels and a jacket but they haven't wrench sockets, also they may merely use a screw-driver to obviate a jam in certain mechanism parts but they found none of such a tool.

SUMMARY OF THE INVENTION

The present invention especially needed in performing wheel change on a car away from a garage, with its features which may be relevantly used as an operation handle for a manually operated jack, as a pry in removing an automotive wheel cover, as a screw-driver in regulating a machine screw and as a wrench for twisting a bolt or a nut within ranged size.

The present invention particularly seeks to combine a screwdriver, a wrench socket and a jack operable section forming an operation bar of a jack so as together the jack in one united tool to be easily carried and separable being independent tools for various uses.

Moreover, the present invention seeks to construct an adjustable wrench socket which particularly for fitting on one of a ranged hexagonal shaped screw-nuts or bolt-heads, and prevent the wearing of the angle portions of said screw-nut or bolt-head when use.

In an adjustable wrench head (or socket), U.S. Pat. No. 3,318,176 for example, which comprises a socket enclosure in a shape substantially pentagonal and an insert in variable distance into said enclosure to grip a pentagonal screw-nut or bolt-head firmly therein so as to grip said screw-nut or bolt-head. As is well known, refer to the drawings of the patent, each lateral of a pentagonal nut absolutely faces an opposite angle thereof and the nut, even if its size is smaller than the enclosure, can be firmly gripped between the insert and the corresponding angle of the enclosure.

But to a hexagonal nut, each lateral faces an opposite lateral thereof and each angle faces an opposite angle thereof. Therefore, a socket enclosure for the hexagonal nut like present invention shall consider that, if the insert in a direction facing an angle of the enclosure, FIG. 6A, which (the insert) shall depress on a corresponding angle of the hexagonal nut and cause a weak grip to the nut when truning of the wrench; on the other hand, if the insert in a direction perpendicular to one pair of opposite laterals of the enclosure to grip a hexagonal nut, said nut is by only two opposite laterals to be clipped therebetween, FIG. 6B, and if the nut is a smallest one in size, then both laterals of the nut which are gripped will be easily worn when turning of the wrench, or said small nut may be, FIG. 6C, sliding aside from the center of the gripping force and causing a weak grip when turning of the wrench.

Present invention wrench socket portion has improved disadvantages described above and in such a manner that by modification of the configuration of the hexagonal enclosure, to elongate the distance between one pair of parallel laterals which perpendicular to the insert, to ensure at least two laterals of even a smallest screw-nut always be kept (both neighboring laterals of one lateral) in contact with two appropriate laterals of the enclosure tightly and no more sliding from the center of the grip force FIG. 5.

One object of the present invention is to provide a jack operating bar comprising a jack connecting section conjunctable to one end of a handle section, said handle section having one end provided with a screw driver and having another end provided with a wrench socket head adjustable to grip any one of ranged hexagonal nuts. Both said portions conjuncted in an operating bar being attached to the jack into an united tool so as to be easily carried by an user.

Another object of the present invention is to provide a wrench socket head on said operating bar comprising a hexagonal enclosure having an elongate distance between one pair of parallel laterals thereof, an insert in variable distance into said enclosure in a direction perpendicular to said pair of parallel laterals of said enclosure so as to firmly grip any one of ranged hexagonal screw-nuts or bolt-heads.

Other functional and structural features of the present invention will become apparent taken in conjunction with the accompanying drawing and the following detailed description.

BRIEF DESCRIPTION OF THE DRAWINGS

FIG. 3 is a perspective view of another preferred embodiment of the invention showing the handle section 12 in a straight shape.

FIG. 4 is an assembled view of FIG. 2 showing one end of said handle section 12 is received in a jack connecting section 11.

FIG. 5 is a top plan view of the wrench socket 2 showing the enclosure 21 having an elongate distance between one pair of opposite laterals 211 and 211', by which a depressed smallest nut 3 will not be sliding aside of the grip insert 22.

FIG. 6 illustrate disadvantages of an insert 22 in two way into a regular hexagonal enclosure 21 to grip a relatively smaller hexagonal nut 3.

FIG. 6A is showing that the insert 22 in a direction facing one pair of opposite angles of the enclosure 21 and depressing on one angle point of the hexagonal nut 3, which will wear the angle point of the nut when turning of the socket.

FIGS. 6B, 6C are showing that the insert 22 in a direction perpendicular to one pair of opposite laterals of the enclosure 21 and depressing on one lateral of a relatively smaller screw-nut 3, in which, FIG. 6B, small nut 3 right under the center of the grip force and by its two opposite laterals gripped therebetween which will cause a relatively weaker grip and, in FIG. 6C, small nut 3 aside from the gripping force which will also cause a relatively weaker grip when truning of the socket 2.

DETAILED DESCRIPTION OF THE PREFERRED EMBODIMENT

Figure 1:
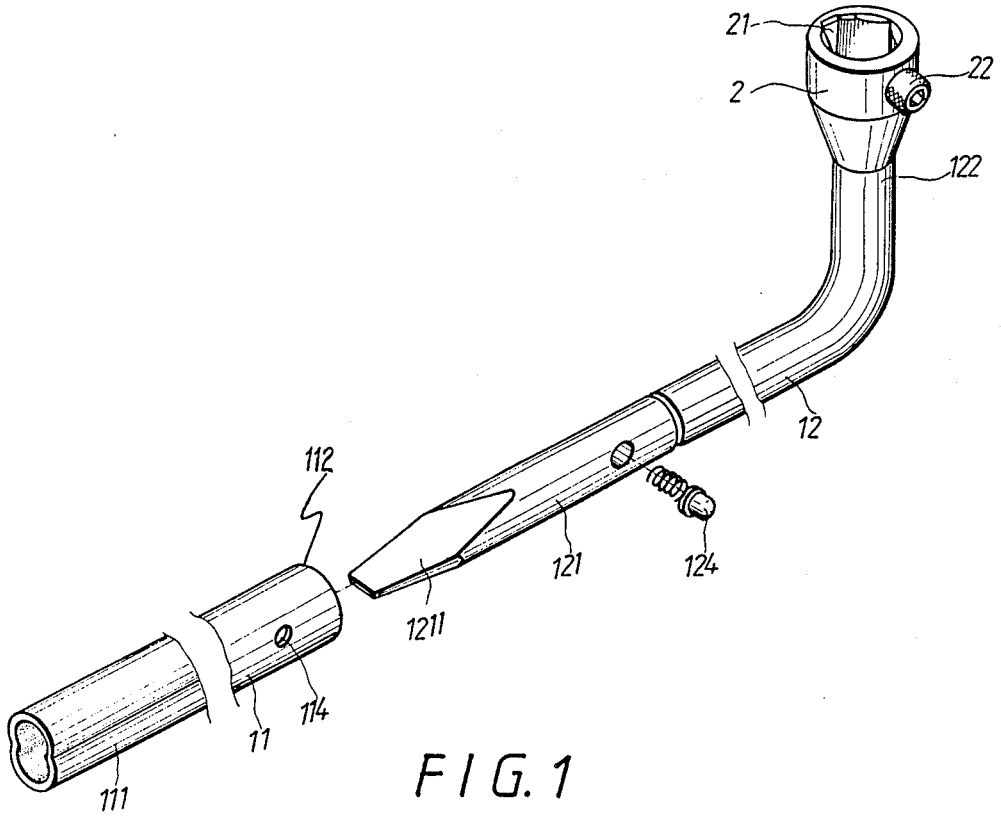
FIG. 1 is a perspective view of one preferred embodiment of the invention, which having a handle section in arm shape operable as a pry.

As shown in FIGS. 1, 2, 3 and 4, the present invention jack operating bar comprising an connecting section 11 and a handle section 12 counjected in a bar by a resilent steel ball 124 on section 12 inserting outward through an opening 114 on section 11, connecting section 11 made from a hard metalic pipe having one end 111 integrally formed in a shape suitably fitting in a portion of a jack (not shown) to operate the jack and having another hollow end 112 to fit on an end portion 121 of the handle section 12.

At the end of portion 121 of handle section 12 is provided with a screw-driver 1211 and at another end thereof with a socket mount 122, a recess 123 in the center of the socket mount 122 as to receive a end portion 23 of an invention wrench socket 2.

Figure 2:
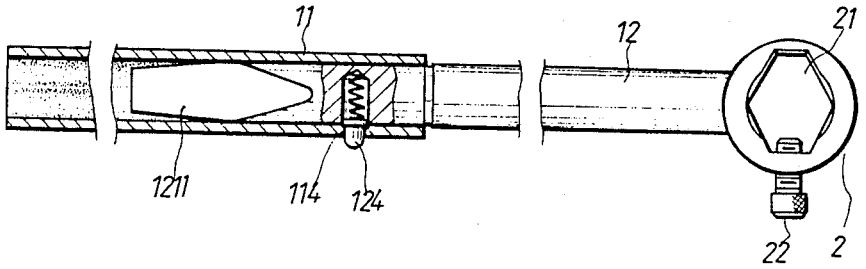
FIG. 2 is an assembled view of FIG. 1 showing one end of said handle section 12 is received in a jack connecting section 11.

Wrench socket 2, FIGS. 2, 4 and 5, having an end portion 23 provided with a side steel-ball 231 suitable to firmly position the end portion 23 in the opening 123 of socket mount 122 and having a head portion provided therein with a recess 21 of a hexagonal enclosure, a screw insert 22 in variable distance into the enclosure in a direction perpendicular to one pair of parallel lateral walls 211 and 211' of the enclosure 21, FIG. 5.

Enclosure 21 having a modified configuration of a regular hexagonal as shown in FIG. 5, which the distance between the pair laterals 211 and 211' has been elongated to ensure even a smallest screw-nut 3 not being sliding from the grip insert 22 and kept at least two laterals (two neighboring laterals of one lateral) of the nut 3 contacting with two appropriate laterals of the enclosure 21, so as to firmly grip the screw-nut 3 in the enclosure.

Screw insert 22 serves as to grip any one of ranged screw-nuts or bolt-heads 3 in the enclosure 21 merely by adjustment of the insertion depth of the insert 22 in the enclosure 21.

Wrench socket 2 can be in various size enclosures 21 but in one size of the end portion 23, each size socket enclosure 21 will be adapted for one range of screw-nuts or bolt-heads.

Handle section 12 intergrally formed with a screw-driver at one end, which when seperated form the connecting section 11 will be as an independent screw-driver to tool. Also handle section 12 can be bent as a pry to tool (FIG. 1).

I claim:

1. A multi-functional bar for a jack comprising:

a pipe-like metallic jack connecting section, said connecting section having a first and second end, said first end for connecting to the operative portion of a jack, and said second end for connecting to a handle section;

a metallic rod-like handle section, said handle section having a first and second end, said first end of said handle section having an integrally attached screw-driver, and said second end of said handle section having an integrally attached socket wrench mount, said socket wrench mount having an opening for detachably receiving an adjustable socket wrench; and an adjustable socket wrench, said adjustable socket wrench having a first and second end, said first end having an integrally attached portion for being detachably received by said opening of said socket wrench mount, said second end including a center recess defining a substantially hexagonal enclosure having three pairs of spaced opposed laterals, the distance between the laterals of one pair of spaced opposed laterals of said substantially hexagonal enclosure being greater than the distance between the respective laterals of the other pairs of spaced opposed laterals thereof, and a set screw being inserted through a first lateral of said one pair of spaced opposed laterals toward the second lateral of said one pair of spaced opposed laterals for firmly gripping a nut or bolthead between said set screw and said second lateral of said one pair of spaced opposed laterals.

2. A multi-functional bar for a jack comprising:

a pipe-like metallic jack connecting section, said connecting section having a first and second end, said first end for connecting to the operative portion of a jack, and said second end for connecting to a handle section;

a metallic rod-like handle section, said handle section having a first and second end, said first end of said handle section having an integrally attached screw-driver, and said second end of said handle section having an integrally attached adjustable socket wrench; and said adjustable socket wrench including a center recess defining a substantially hexagonal enclosure having three pairs of spaced opposed laterals, the distance between the laterals of one pair of spaced opposed laterals of said substantially hexagonal enclosure being greater than the distance between the respective laterals of the other pairs of spaced opposed laterals thereof, and a set screw being inserted through a first lateral of said one pair of spaced opposed laterals toward the second lateral of said one pair of spaced opposed laterals for firmly gripping a nut or bolthead between said set screw and said second lateral of said one pair of spaced opposed laterals.

* * * * *